US008126169B2

(12) United States Patent
Onohara

(10) Patent No.: US 8,126,169 B2
(45) Date of Patent: Feb. 28, 2012

(54) SUPER MAGNETOSTRICTION SPEAKER

(75) Inventor: Hirofumi Onohara, Tokyo (JP)

(73) Assignee: Foster Electric Company, Tokyo (JP)

( * ) Notice: Subject to any disclaimer, the term of this patent is extended or adjusted under 35 U.S.C. 154(b) by 967 days.

(21) Appl. No.: 11/912,459

(22) PCT Filed: Apr. 27, 2006

(86) PCT No.: PCT/JP2006/308859

§ 371 (c)(1),
(2), (4) Date: Apr. 28, 2008

(87) PCT Pub. No.: WO2006/118205

PCT Pub. Date: Nov. 9, 2006

(65) Prior Publication Data

US 2008/0205674 A1 Aug. 28, 2008

(30) Foreign Application Priority Data

Apr. 28, 2005 (JP) ..... 2005-131909

(51) Int. Cl.
*H04R 15/00* (2006.01)

(52) U.S. Cl. ..... 381/190

(58) Field of Classification Search ..... 381/190
See application file for complete search history.

(56) References Cited

U.S. PATENT DOCUMENTS 5,457,752 A 10/1995 Engdahl et al.

(Continued)

FOREIGN PATENT DOCUMENTS

CN 1069846 A 3/1993

(Continued)

OTHER PUBLICATIONS

Japan Patent Office Communication (2005-131909), May 24, 2011, 3 pages including translation.

(Continued)

*Primary Examiner* — Alexander Ghyka
*Assistant Examiner* — Stanetta Isaac
(74) *Attorney, Agent, or Firm* — Finnegan, Henderson, Farabow, Garrett & Dunner, L.L.P.

(57) ABSTRACT

A supermagnetostriction speaker featuring good acoustic characteristics when used being placed on a horizontal surface. The supermagnetostriction speaker comprises a yoke of a cylindrical shape having a bottom and a lid and constituting a magnetic path; a supermagnetostriction element which is fixed at its one end to the lid of the yoke, has the other end which is a free end, and is arranged in the direction of cylinder of the yoke to generate displacement depending upon a variation in the magnetic field; a coil arranged to surround the supermagnetostriction element in the yoke and generates a magnetic field in response to signals fed from an external unit; a vibration rod having a flange at an intermediate portion thereof and is so arranged that the one end thereof comes in contact with the free end of the supermagnetostriction element and that the other end thereof penetrating through the center hole in the bottom of the yoke transmits the displacement of the supermagnetostriction element to an external body; a rubbery elastic body arranged being held between the flange of the vibration rod and the bottom of the yoke; and a body portion exerting a load on the supermagnetostriction element via the yoke in a state where the other end of the vibration rod is placed on the external body in a manner that the supermagnetostriction speaker stands by itself, so that the displacement of the supermagnetostriction element is effectively transmitted to the external body due to the mass.

9 Claims, 4 Drawing Sheets

U.S. PATENT DOCUMENTS

| | | | | |
|---|---|---|---|---|
| 2002/0195172 | A1* | 12/2002 | Arai et al. | 148/121 |
| 2006/0147051 | A1 | 7/2006 | Smith et al. | |

FOREIGN PATENT DOCUMENTS

| | | | |
|---|---|---|---|
| CN | 2429984 | | 5/2001 |
| CN | 2469648 | | 1/2002 |
| JP | 2005-20497 | | 3/1993 |
| JP | 06-086575 | | 3/1994 |
| JP | 2002-315370 | | 10/2002 |
| JP | 2005-094448 | | 4/2005 |
| WO | WO 2004/057912 | A2 | 7/2004 |
| WO | WO 2004/068900 | A1 | 9/2004 |
| WO | WO 2004/084578 | A1 | 10/2004 |
| WO | WO 2004/114723 | A2 | 12/2004 |

OTHER PUBLICATIONS

Japan Patent Office Communication (2005-131909), Dec. 14, 2010, 3 pages including translation.

Chinese Patent Office Communication (200680014174.7), Sep. 7, 2010, 7 pages.

Chinese Patent Office Communication (200680014174.7), Mar. 30, 2011, 7 pages.

* cited by examiner

SUPER MAGNETOSTRICTION SPEAKER

TECHNICAL FIELD

This invention relates to a supermagnetostriction speaker which vibrates, as a vibration plate, an external body by utilizing a supermagnetostriction phenomenon that occurs in the supermagnetostriction element. Supermagnetostriction has the same meaning as giant-magnetostrictive.

BACKGROUND ART

A magnetostriction phenomenon has been known in which a material changes its form in a magnetic field given from an external unit. The material that develops the supermagnetostriction phenomenon is called supermagnetostriction material. A new supermagnetostriction material has been developed in recent years producing a dimensional change of 1000 ppm or more in a state where a magnetic field is applied to the supermagnetostriction material from the external unit.

It has further been known that the supermagnetostriction materials generate a large stress, and some of them attain 400 $kgf/mm^2$ or more. Further, the supermagnetostriction material quickly responds when it comes to a change in the shape of the material for a magnetic field from the external unit, and some of them change the size in less than one microsecond after the magnetic field is applied.

It has been attempted to form a supermagnetostriction material of this type as a rod-like supermagnetostriction element and to use the dimensional change produced by the supermagnetostriction element as an actuator. It has further been attempted to use the actuator based on the magnetostriction element as a drive source for a speaker.

The following patent document discloses an art of using, as a speaker, a rod-like supermagnetostriction element obtained by using the supermagnetostriction material.

Patent document 1: JP-A-10-145892 (page 1, FIG. 1)

DISCLOSURE OF THE INVENTION

Problems to be Solved by the Invention

The supermagnetostriction speaker disclosed in the above patent document 1 is the one that vibrates a windowpane, a wall surface, or a picture or a photograph hanging on the wall as a vibration plate so as to operate as a speaker. Here, the windowpane, wall surface and picture or photograph hanging on the wall surface are materials that can be vibrated relatively easily, and can be easily used as vibration plates.

However, if it is presumed that the supermagnetostriction speaker is placed on a floor surface to use the floor surface as a vibration plate or that the supermagnetostriction speaker is placed on a relatively rigid table to use the table surface as a vibration plate, a problem arouses in that the floor surface or the table surface is so tough and rigid yet having a large area that the displacement of the supermagnetostriction element is used for vibrating the supermagnetostriction speaker itself and the speaker fails to produce a sufficiently large volume of sound.

In this connection, further, if it is attempted to vibrate the tough and rigid floor surface of a large area or the table surface by using the supermagnetostriction speaker, a problem newly occurs in that the supermagnetostriction speaker cannot produce voice maintaining high sound quality and high fidelity.

This invention was accomplished in order to solve the above problems and has an object of providing a supermagnetostriction speaker which, when used being placed on a horizontal surface, is capable of realizing operation as a speaker maintaining good acoustic characteristics.

Means for Solving the Problems

In order to solve the above problems, a supermagnetostriction speaker of the invention comprises a yoke of a cylindrical shape having a bottom and a lid and constituting a magnetic path; a supermagnetostriction element which is fixed at its one end to the lid of the yoke, has the other end which is a free end, and is arranged in the direction of cylinder of the yoke to generate displacement depending upon a variation in the magnetic field; a coil arranged to surround the supermagnetostriction element in the yoke and generates a magnetic field in response to signals fed from an external unit; a vibration rod having a flange at an intermediate portion thereof and is so arranged that the one end thereof comes in contact with the free end of the supermagnetostriction element and that the other end thereof penetrating through the center hole in the bottom of the yoke transmits the displacement of the supermagnetostriction element to an external body; a rubbery elastic body arranged being held between the flange of the vibration rod and the bottom of the yoke; and a body portion having a predetermined mass, and exerting a load on the supermagnetostriction element via the yoke in a state where the other end of the vibration rod is placed on the external body in a manner that the supermagnetostriction speaker stands by itself, so that the displacement of the supermagnetostriction element is effectively transmitted to the external body due to the mass.

In the supermagnetostriction speaker, it is desired that the vibration rod has, at the other end thereof, a vibration contact plate having an area larger than the sectional area of the vibration rod, and transmits the displacement of the supermagnetostriction element to the external body via the vibration contact plate.

In the supermagnetostriction speaker, further, it is desired that the vibration contact plate is made of a material and has an area that differ depending upon the frequency component and amplitude of vibration that is to be transmitted, and is detachably attached to the other end of the vibration rod.

It is desired that the supermagnetostriction speaker further includes a first bias magnet arranged between one end of the supermagnetostriction element and the lid of the yoke, and a second bias magnet arranged between the other end of the supermagnetostriction element and the vibration rod, and that the first bias magnet and the second bias magnet generate magnetic fields in the same direction as the axial direction of the supermagnetostriction element.

In the supermagnetostriction speaker, further, it is desired that the supermagnetostriction element is divided into a first supermagnetostriction element close to the lid of the yoke and a second supermagnetostriction element close to the bottom of the yoke, and that a third bias magnet is arranged between the first supermagnetostriction element and the second supermagnetostriction element to generate a magnetic field in the same direction as those of the first bias magnet and the second bias magnet.

In the supermagnetostriction speaker, further, it is desired that the body portion is so constituted as to possess the center of gravity on the side lower than the center of the yoke.

Effect of the Invention

According to the supermagnetostriction speaker of the invention, the vibration rod is so arranged as to transmit the displacement of the supermagnetostriction element to the external body via the vibration rod having the flange at the intermediate portion thereof, and the other end of the vibration rod is placed on the external body in a manner that the supermagnetostriction speaker stands by itself enabling the body portion to exert a load on the supermagnetostriction element via the yoke, so that the displacement of the supermagnetostriction element is effectively transmitted to the external body due to the mass of the body portion.

Therefore, the external body vibrates due to the displacement of the supermagnetostriction element in response to the signals fed to the coil. Here, the rubbery elastic body is arranged being held between the flange of the vibration rod and the bottom of the yoke, and the vibration due to the displacement of the supermagnetostriction element is quickly converged due to the attenuating force without being imparted with extra vibration.

When the supermagnetostriction speaker is used being placed on a horizontal surface such as the floor surface or the table surface, therefore, operation is realized featuring good acoustic characteristics. In the invention of the supermagnetostriction speaker, the displacement of the supermagnetostriction element is transmitted to the external body via the vibration contact plate of an area larger than the sectional area of the vibration rod.

When the supermagnetostriction speaker is used being placed on the horizontal surface, therefore, the displacement of the supermagnetostriction element can be reliably and faithfully transmitted to the external body to thereby realize the operation featuring good acoustic characteristics.

In the invention of the supermagnetostriction speaker, further, the vibration contact plate is made of a material and has an area that differ depending upon the frequency component and amplitude of vibration that is to be transmitted, and is detachably attached to the other end of the vibration rod. When the supermagnetostriction speaker is used being placed on the horizontal surface, therefore, the displacement of the supermagnetostriction element can be reliably and faithfully transmitted to the external body depending upon the use and the purpose to thereby realize the operation featuring good acoustic characteristics.

In the invention of the supermagnetostriction speaker, further, the supermagnetostriction element is held by a plurality of bias magnets; i.e., a uniform bias magnetic field is applied to the supermagnetostriction element to thereby realize the operation featuring good acoustic characteristics.

In the invention of the supermagnetostriction speaker, further, the body portion is so constituted as to possess the center of gravity on the side lower than the center of the yoke. When the supermagnetostriction speaker is used being placed on the horizontal surface, therefore, the displacement of the supermagnetostriction element can be reliably and faithfully transmitted to the external body to thereby realize the operation featuring good acoustic characteristics.

DESCRIPTION OF REFERENCE NUMERALS

Figure 1:
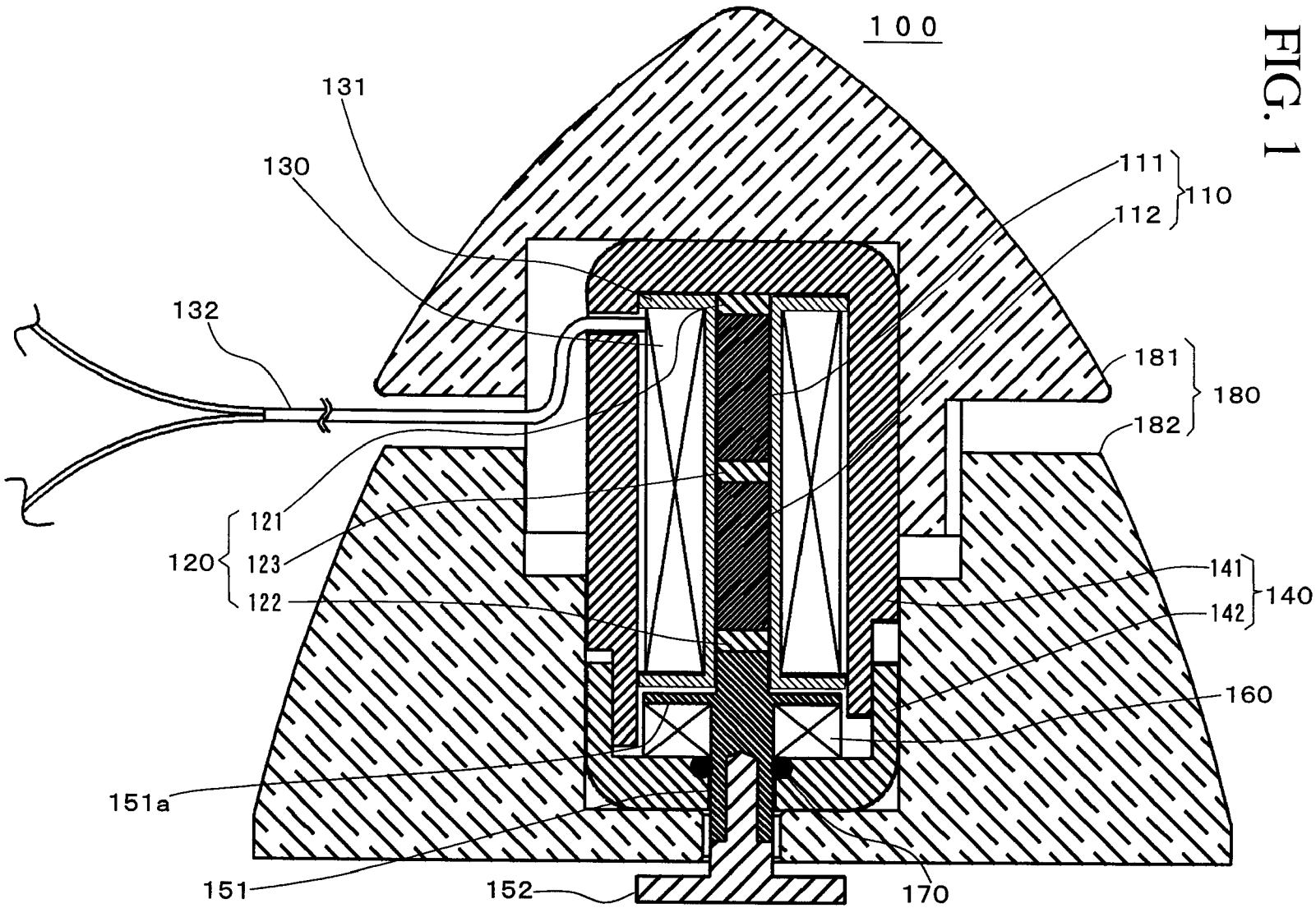
FIG. 1 is a view illustrating the constitution of a supermagnetostriction speaker according to a first embodiment of the invention.

100 supermagnetostriction speaker
101 control portion
110 supermagnetostriction element
111 first supermagnetostriction element
112 second supermagnetostriction element
120 bias magnet
121 first bias magnet
122 second bias magnet
123 third bias magnet
130 coil
140 yoke
141 upper yoke
142 bottom yoke
151 vibration rod
152 contact
160 damper
170 O-ring
180 body portion
181 upper body
182 bottom body

BEST MODE FOR CARRYING OUT THE INVENTION

Described hereinbelow in detail with reference to the drawings is the best mode (hereinafter, embodiment) for carrying out the invention. FIG. 1 is a sectional view illustrating the sectional constitution of a supermagnetostriction speaker according to a first embodiment of the invention.

In the supermagnetostriction speaker 100 shown in FIG. 1, a supermagnetostriction element 110 is a supermagnetostriction element formed like a rod by using a supermagnetostriction material that exhibits a supermagnetostriction phenomenon in which the material changes its shape when a magnetic field is applied thereto. The supermagnetostriction element 110 is constituted by a first supermagnetostriction element 111 close to the lid of the yoke and a second supermagnetostriction element 112 close to the bottom of the yoke.

A bias magnet 120 is constituted by a first bias magnet 121, a second bias magnet 122 and a third bias magnet 123, and applies a bias magnetic field in the axial direction of the supermagnetostriction element 110.

Here, the first bias magnet 121 is arranged between one end of the supermagnetostriction element 111 and the lid of the yoke, and applies a bias magnetic field in the axial direction of the supermagnetostriction element 111. The second bias magnet 122 is arranged between one end of the supermagnetostriction element 112 and the vibration rod, and applies a bias magnetic field in the axial direction of the supermagnetostriction element 112. The third bias magnet 123 is arranged between the supermagnetostriction element 111 and the supermagnetostriction element 112, and applies a bias magnetic field in the axial direction of the supermagnetostriction element 111 and the supermagnetostriction element 112.

The first bias magnet 121, second bias magnet 122 and third bias magnet 123 generate magnetic fields for the supermagnetostriction element 111 and the supermagnetostriction element 112 in the same direction which is in the axial direction of the supermagnetostriction element.

A solenoid coil 130 is arranged being wound on a coil bobbin 132 surrounding the supermagnetostriction element 110, and generates a magnetic field around the supermagnetostriction element 110 in response to signals fed from an external unit through a wire 132.

A yoke 140 is of a cylindrical shape having a bottom and a lid, forms a magnetic path, and is constituted by an upper yoke 141 which includes an upper side of the cylinder and the lid, and a bottom yoke 142 which includes a lower side of the cylinder and the bottom.

A center hole is formed near the center of the bottom of the bottom yoke 142, and a vibration rod that will be described later is penetrating therethrough. The upper yoke 141 and the bottom yoke 142 are threaded at portions that come in contact with each other so as to fit together. The rod-like supermagnetostriction element 110 is arranged near the center axis of the cylindrical yoke 140, and the coil 130 is wound to surround it. A magnetically closed circuit is constituted by the yoke 140, the supermagnetostriction element 110 and a vibration rod 151 that will be described later.

One end of the vibration rod 15 is in contact with the free end of the supermagnetostriction element 110 (supermagnetostriction element 111 in FIG. 1). The other end of the vibration rod 151 penetrates through the center hole in the bottom of the bottom yoke 142 and transmits the displacement occurring in the supermagnetostriction element 110 to the external body.

In this embodiment, the displacement of the supermagnetostriction element stands for a displacement based on a change in the shape caused by a change in the magnetic field applied to the supermagnetostriction element. The vibration rod 151 is so constituted as to possess a flange 151*a* at the intermediate portion thereof. The vibration rod 151, further, has, on the other end side thereof (on the external body side), a contact 152 which is a vibration contact plate having an area larger than the sectional area of the vibration rod 151. The vibration rod 151 transmits the displacement of the supermagnetostriction element 110 to the external body via the contact 152.

A damper 160 is an elastic body for absorbing vibration and is, desirably, a rubbery elastic body which is arranged being held between the flange 151*a* of the vibration rod 151 and the bottom of the bottom yoke 142. In a state where the upper yoke 141 and the bottom yoke 142 are screwed together, the damper 160 is placed in a state where it receives a force toward the contracting side.

An O-ring 170 is provided as slipping means for reducing the frictional resistance relative to the center hole in the bottom yoke 142 as the vibration rod penetrating through the center hole in the bottom of the bottom yoke 142 vibrates in response to the displacement of the supermagnetostriction element 110.

A body portion 180 has an inner space for holding the yoke 140 and a bottom hole through which the vibration rod 151 penetrates and, further, has a predetermined mass. In a state where the contact 152 is placed on the external body so that the supermagnetostriction speaker 100 stands by itself, the body portion 180 exerts the load on the supermagnetostriction element 110 via the yoke 140. By utilizing its mass, further, the body portion 180 effectively transmits the displacement of the supermagnetostriction element 110 to the external body.

The body portion 180 is constituted being divided into an upper body 181 and a bottom body 182. The upper body 181 and the bottom body 182 are integrated together in a state where the yoke 140 is contained in the inner space thereof.

Figure 2:
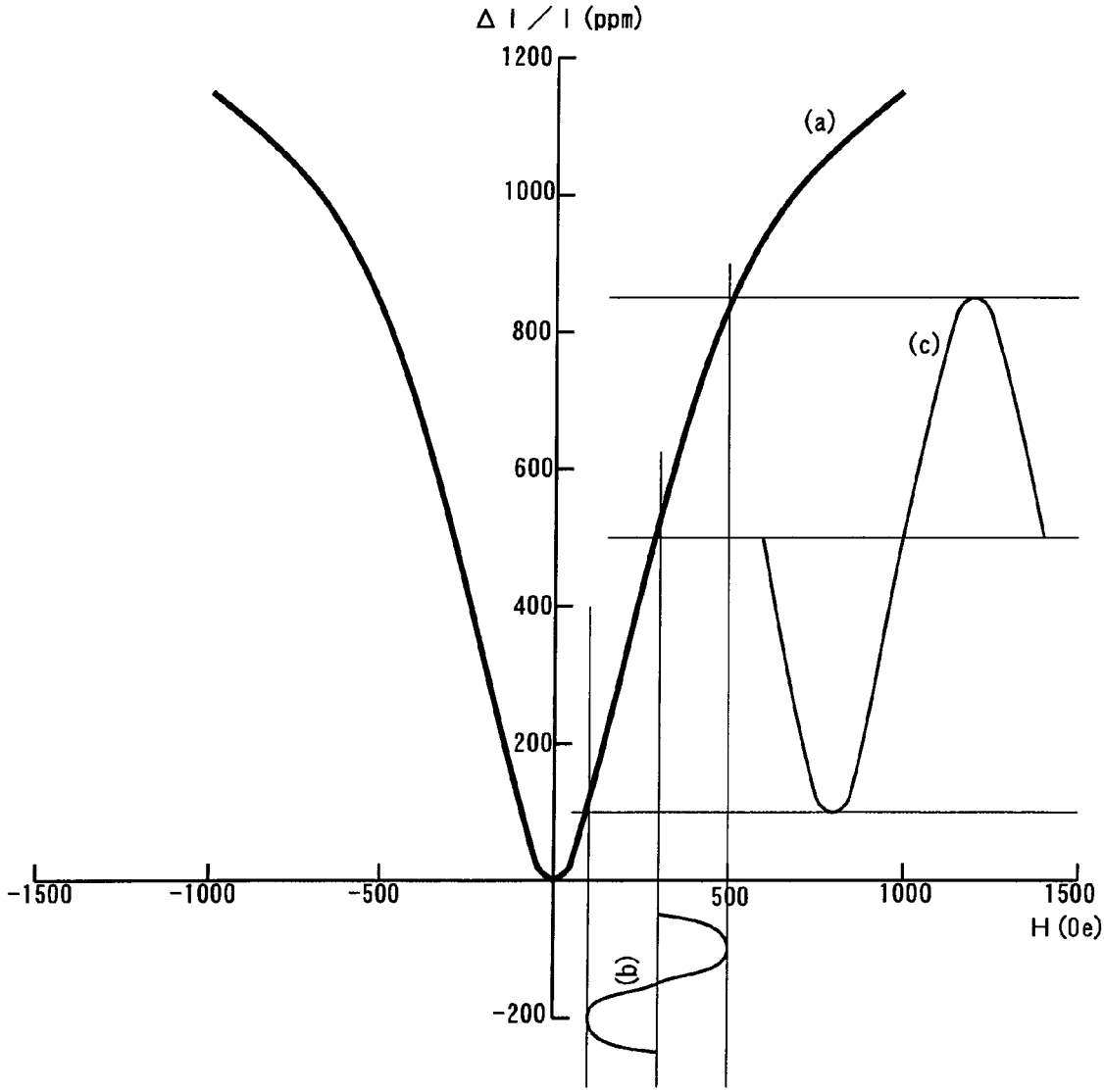
FIG. 2 is a diagram of characteristics of a supermagnetostriction element in the supermagnetostriction speaker according to the first embodiment of the invention.

FIG. 2(*a*) illustrates a relationship between a magnetic field H applied to the supermagnetostriction element 110 and a change of shape (magnetostriction) ΔI/I which causes displacement to the supermagnetostriction element 110 due to the magnetic field H. The characteristics exemplified here are such that the magnetostriction due to the magnetic field H increases with an increase in the magnetic field H in either the positive or negative direction.

Therefore, while applying a bias magnetic field to the supermagnetostriction element 110, the magnetic field is varied in response to the signals with the bias magnetic field as a center (FIG. 2(*b*)) to thereby obtain displacement or vibration in response to the signals (FIG. 2(*c*)).

Here, by using a region of good linearity in relation to the signals and magnetostriction, it is made possible to generate faithful vibration in response to a change in the magnetic field. It is therefore desired to select in advance the bias magnetic field based on the bias magnets 121 to 123 at the center of the region having good linearity as described above.

Figure 3:
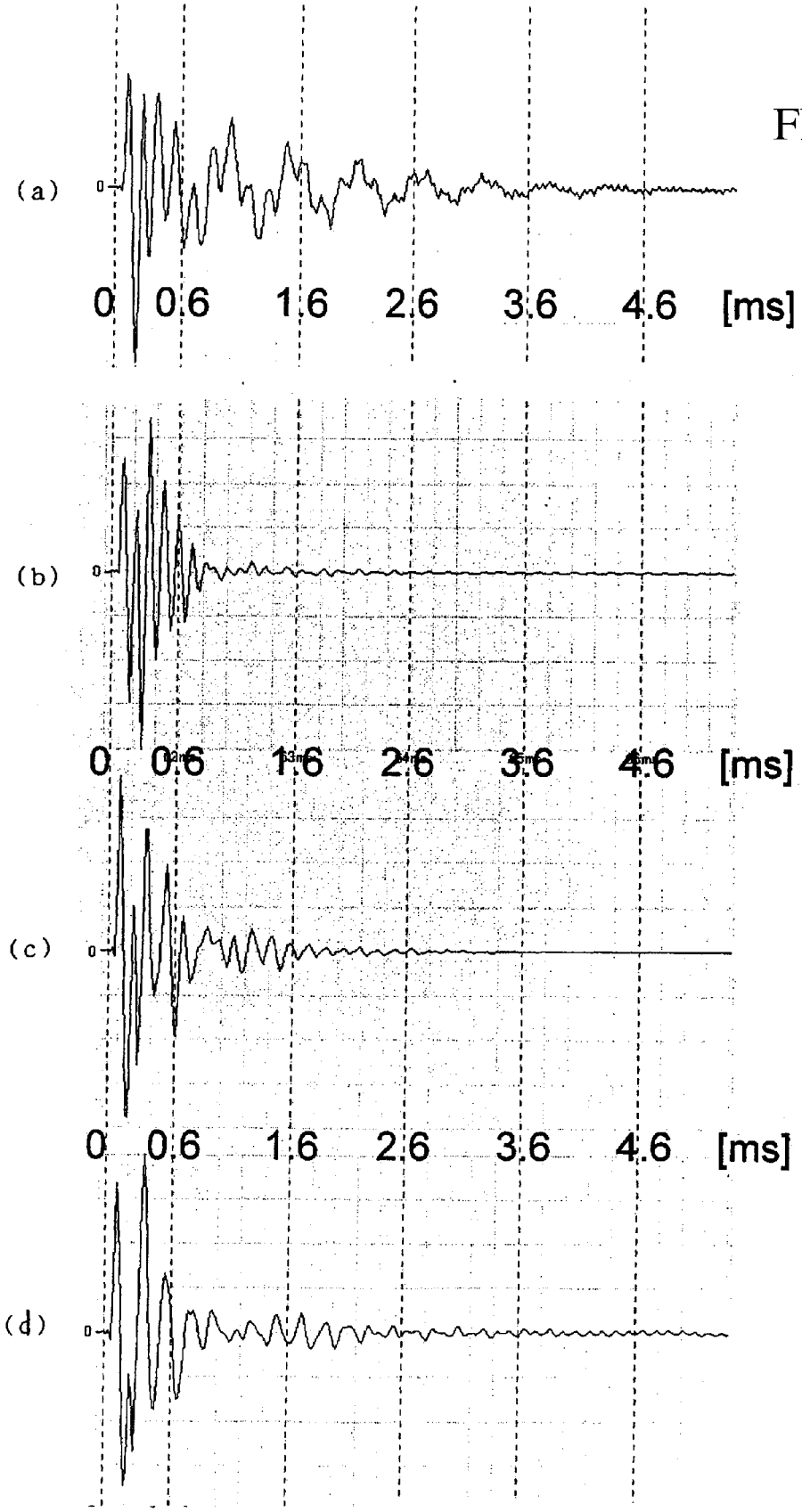
FIG. 3 is a diagram of characteristics of when the damper material of the supermagnetostriction speaker according to the first embodiment of the invention is changed.

FIG. 3 is a diagram of characteristics illustrating attenuation modes of the supermagnetostriction speaker 100 due to the displacement of the supermagnetostriction element 110 by using various materials as the damper 160. The diagram illustrates vibration modes immediately after the interruption of signals following a state where pulse-like signals were fed to the coil 130. An absolute value of vibration varies depending upon the mass of the supermagnetostriction speaker 100, amplitude of the signals and shape of the coil 130. In FIG. 3, however, the conditions are set to be the same except the materials of the damper 160.

FIG. 3(*a*) shows vibration attenuation characteristics of when a coil spring having a spring constant of 7.6 [N/mm] is used as the damper 160, wherein the vibration remains not converged for not shorter than 3 milliseconds. Therefore, the signal waveform fed to the coil 130 is no longer in agreement with the vibration waveform, distortion increases and it becomes difficult to obtain vibration faithful to a change in the magnetic field.

FIG. 3(*b*) shows vibration attenuation characteristics of when a lowly elastic rubber having a hardness of 32° is used as the damper 160, wherein the vibration is nearly converged in about one millisecond. Therefore, the signal waveform fed to the coil 130 is nearly in agreement with the vibration waveform, distortion is small, and vibration that is obtained becomes faithful to a change in the magnetic field.

FIG. 3(*c*) shows vibration attenuation characteristics of when a butyl rubber having a hardness of 65° is used as the damper 160, wherein the vibration is nearly converged in about 1.6 milliseconds. Therefore, the signal waveform fed to the coil 130 is nearly in agreement with the vibration waveform, distortion is small, and vibration that is obtained becomes faithful to a change in the magnetic field.

FIG. 3(*d*) shows vibration attenuation characteristics of when a silicone rubber having a hardness of 50° is used as the damper 160, wherein the vibration is nearly converged in about 2.6 milliseconds. After the passage of 0.6 milliseconds, regular vibration of a small amplitude continues. Therefore, the signal waveform fed to the coil 130 is nearly in agreement with the vibration waveform generating slight sound as a lingering tone, distortion is small, and vibration that is obtained becomes faithful to a change in the magnetic field.

As described above, in a state where the other end (contact 152) of the vibration rod is placed on an external body such as a floor or a table in a manner that the supermagnetostriction speaker 100 stands by itself, the mass of the body portion 180 is exerted as a load on the supermagnetostriction element 110 via the yoke 140. Therefore, the displacement of the supermagnetostriction element 110 is effectively transmitted to the external body due to the mass of the body portion 180.

Therefore, not only the supermagnetostriction speaker 100 itself but also the external body undergo the vibration due to the displacement of the supermagnetostriction element 110 in response to the signals fed to the coil 130. Here, the damper 160 of a rubbery elastic body is held between the flange 151*a* of the vibration rod 151 and the bottom of the yoke 140, and the vibration due to the displacement of the supermagnetostriction element 110 is quickly converged due to the attenuating force without being imparted with extra vibration.

Further, the present inventors have conducted experiment to measure the frequency characteristics of the supermagnetostriction speaker 100, and obtained the following results. That is, when the coil spring is used as the damper 160, a peak occurs conspicuously at around 2 kHz while the low zone gradually decreases. Therefore, flat frequency characteristics are not obtained, and characteristics desired for the magnetostriction speaker are not obtained.

When the lowly elastic rubber having a hardness of 32°, the butyl rubber having a hardness of 65° and the silicone rubber having a hardness of 50° are used as the damper 160, the peak does not occur like that of when the coil spring is used. Besides, characteristics are improved in the low zone, flat frequency characteristics are obtained, and characteristics desired for the magnetostriction speaker are obtained. Accordingly, the signal waveforms fed to the coil 130 become nearly in agreement with the vibration waveforms over a wide range of frequencies, a difference in the level decreases irrespective of the frequency, and vibration that is obtained becomes faithful to a change in the magnetic field.

As a result, when the supermagnetostriction speaker 100 is used being placed on a horizontal surface such as a floor or a table, use of the rubbery elastic material as the damper 160 makes it possible to realize the operation maintaining good acoustic characteristics.

In the supermagnetostriction speaker 100, the displacement of the supermagnetostriction element 110 is transmitted to the external body via the contact 152 which is the vibration contact plate having an area larger than the sectional area of the vibration rod 151. As a result, when the supermagnetostriction speaker 100 is used being placed on the horizontal surface, the displacement of the supermagnetostriction element 110 can be reliably and faithfully transmitted to the external body, and the operation can be realized maintaining good acoustic characteristics.

In the supermagnetostriction speaker 100, further, it is desired that the contact 152 which is the vibration contact plate is made of a material and has an area that differ depending upon the frequency component (wide/narrow frequency characteristics) of vibration to be transmitted and upon the amplitude thereof (large/small sound volume). It is desired that the contact 152 is attached in a manner of being allowed to be replaced such as being screwed into the other end of the vibration rod 151. Upon constituting the contact 152 in a manner that it can be replaced, the displacement of the supermagnetostriction element can be reliably and faithfully transmitted to the external body depending upon the use and the purpose with the supermagnetostriction speaker 100 being placed on the horizontal surface, and the operation can be realized maintaining good acoustic characteristics. Further, the material and the area of the contact 152 which is the vibration contact plate may be changed depending upon the material, hardness and vibration absorption of the floor or the table which is the external body.

In the supermagnetostriction speaker 100, further, the supermagnetostriction element 110 is divided into the first supermagnetostriction element 111 and the second supermagnetostriction element 112, and is held by three bias magnets to thereby apply a uniform magnetic field to the supermagnetostriction element 110 making it possible to realize the operation maintaining good acoustic characteristics.

In the supermagnetostriction speaker 100, further, the body portion 180 is formed in a shape resembling the conical shape or the solid bell shape so as to possess a center of gravity on the side lower than the center of the yoke 140, i.e., so as to possess a low center of gravity. To lower the center of gravity, the bottom body 182 may be made of a material different from that of the upper body 181 and having a large specific gravity. By lowering the center of gravity of the body portion 180, the supermagnetostriction speaker 100 stands by itself maintaining stability when it is used being placed on the horizontal surface. Besides, the displacement of the supermagnetostriction element 110 can be reliably and faithfully transmitted to the external body to realize the operation maintaining good acoustic characteristics.

Upon bringing impedance characteristics of the coil 130 into agreement with the characteristics (about 4Ω to about 16Ω) of general speakers, the supermagnetostriction speaker 100 can be connected to various audio equipment in the same manner as that of general speakers without requiring any particular equipment or wiring and making it easy to handle.

Figure 4:
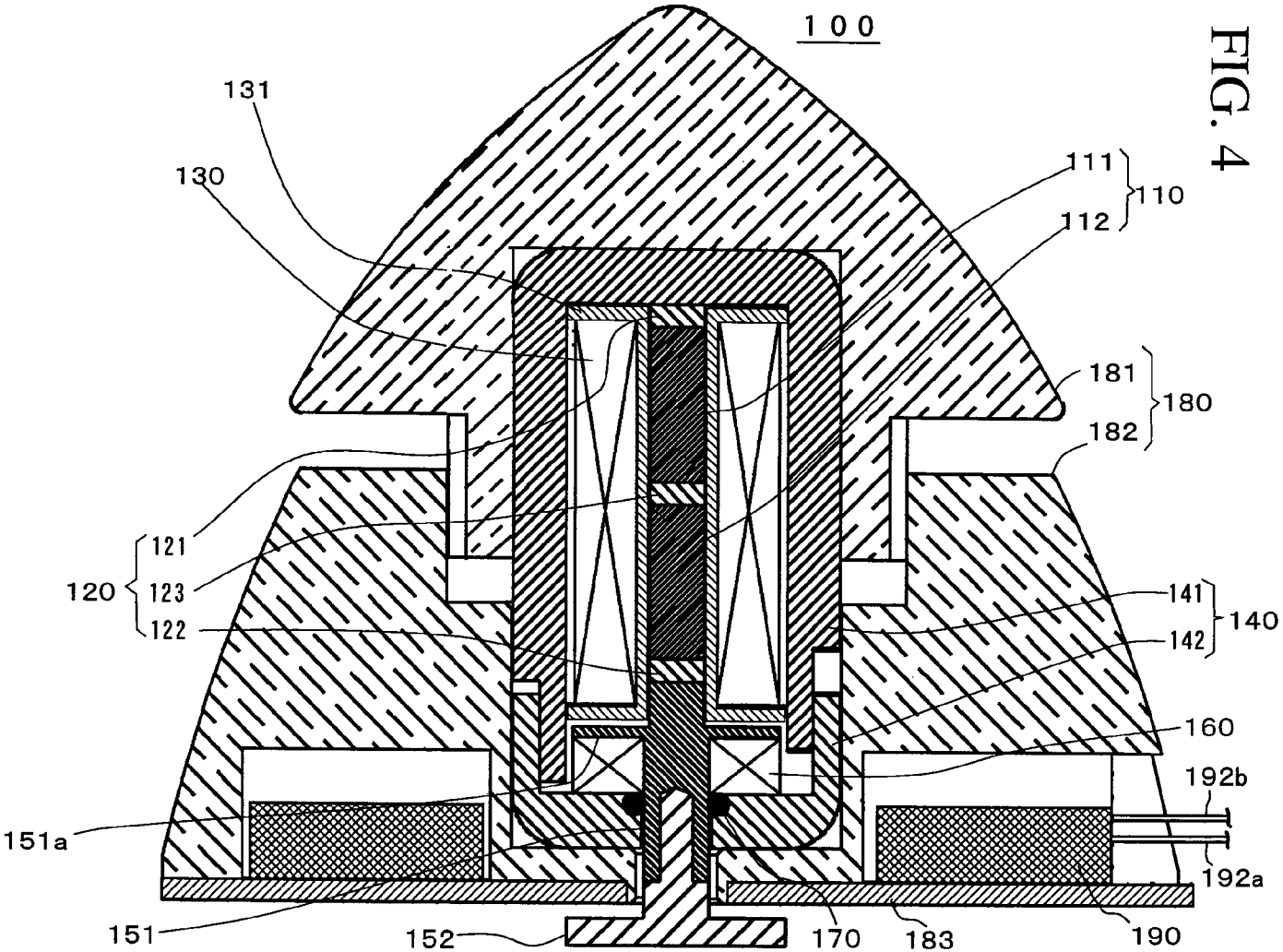
FIG. 4 is a view illustrating the constitution of the supermagnetostriction speaker according to a second embodiment of the invention.

FIG. 4 is a sectional view illustrating the sectional constitution of the supermagnetostriction speaker 100' according to a second embodiment of the invention. The supermagnetostriction speaker 100' according to the second embodiment of FIG. 4 has basically the sectional constitution similar to that of the supermagnetostriction speaker of the first embodiment shown in FIG. 1. Therefore, the same portions are denoted by the same reference numerals but are not described here again.

The supermagnetostriction speaker 100' of the second embodiment has a signal amplifier 190 incorporated in the supermagnetostriction speaker 100'. The signal amplifier 190 is supplied with electric power from an external unit through a wire 192*a* and is supplied with signals from an external unit through a wire 192*b*. The signals amplified by the signal amplifier 190 are fed to the coil 130 through a signal line that is not shown.

According to the constitution which incorporates the signal amplifier 190 as described above, the mass of the body portion 180 is exerted as a load on the supermagnetostriction element 110 via the yoke 140 in a state where the other end (contact 152) of the vibration rod is placed on the external body such as the floor or the table in a manner that the supermagnetostriction speaker 100' stands by itself. Therefore, the displacement of the supermagnetostriction element 110 is effectively transmitted to the external body due to the mass of the body portion 180.

According to the supermagnetostriction speaker 100', the external body vibrates due to the displacement of the supermagnetostriction element 110 in response to the signals amplified through the amplifier 190 and fed to the coil 130. Here, the damper 160 made of a rubbery elastic material is held between the flange 151*a* of the vibration rod 151 and the bottom of the yoke 140, and the vibration due to the displacement of the supermagnetostriction element 110 is quickly converged due to the attenuating force without being imparted with extra vibration.

As a result, the operation is realized maintaining good acoustic characteristics when the supermagnetostriction speaker 100' is used being placed on a horizontal surface such as the floor or the table. The contact 152 can be constituted or modified in the same manner as in the first embodiment to realize the operation maintaining good acoustic characteristics. Further, the supermagnetostriction element 110' and the bias magnet 120 may be arranged in the same manner as in the first embodiment to realize the operation maintaining good acoustic characteristics.

In the supermagnetostriction speaker 100', further, the body portion 180 is formed in a shape resembling the conical shape or the solid bell shape so as to possess a center of gravity on the side lower than the center of the yoke 140, i.e., so as to possess a low center of gravity. To lower the center of gravity, the bottom body 182 may be made of a material different from that of the upper body 181 and having a large specific gravity. By lowering the center of gravity of the body portion 180, the supermagnetostriction speaker 100' stands by itself maintaining stability when it is used being placed on the horizontal surface. Besides, the displacement of the supermagnetostriction element 110 can be reliably and faithfully transmitted to the external body to realize the operation maintaining good acoustic characteristics.

In the body portion 180, a space is provided in a lower portion, and the signal amplifier 190 is arranged in the space to effectively utilize the body portion 180. In this case, a bottom cover 183 holds the signal amplifier 190.

Further, the body portion 180 that is constituted by using a metal also works as means for radiating the heat of the signal amplifier 190 to obtain favorable performance. Upon bringing the input level of the signal amplifier 190 into agreement with the input characteristics of general powered speakers, the connection to various portable audio equipment can be handled in the same manner as that of the general powered speakers to improve the handling without requiring any particular attention.

In the above description, the body portion 180 is formed in a conical shape or a solid bell shape so as to possess the center of gravity on the side lower than the center of the yoke 140. The body portion 180, however, may assume any other shape such as a pyramidal shape with the bottom surface. Or, the body portion 180 may be of a cylindrical shape with its upper portion being light and its lower portion being heavy to realize a low center of gravity.

INDUSTRIAL APPLICABILITY

By placing on the floor or on the table, the supermagnetostriction speaker of the invention can be extensively used to vibrate the floor or the table by utilizing the supermagnetostriction phenomenon that occurs in the supermagnetostriction element. Upon vibrating a table for many people in, for example, a conference room or the like room, therefore, supermagnetostriction speaker can be used for transmitting sound in the whole conference room without the need of executing the work for installing the speakers.

Upon arranging the supermagnetostriction speaker of the invention on each table, further, it is allowed to produce sound that differs for each of the tables or to execute the calling for each of the tables. The supermagnetostriction speaker can be further placed on the floor in a store or on a site of amusement to transmit the sound to the required areas without executing the work for installing the speakers. Further, when placed on the floor of the store or on the site of amusement, supermagnetostriction speaker 100 can be quickly moved as required.

In the general household, too, the supermagnetostriction speaker of the invention can be quickly installed and used depending upon the required place and the required timing.

The invention claimed is:

1. A supermagnetostriction speaker comprising:

a yoke of a cylindrical shape having a bottom and a lid and constituting a magnetic path;

a supermagnetostriction element which is fixed at its one end to the lid of the yoke, has the other end which is a free end, and is arranged in the direction of a cylinder of the yoke to generate displacement depending upon a variation in the magnetic field;

a coil arranged to surround the supermagnetostriction element in the yoke and generate a magnetic field in response to signals fed from an external unit;

a vibration rod having a flange at an intermediate portion thereof and so arranged that the one end thereof comes in contact with the free end of the supermagnetostriction element and that the other end thereof penetrates through the center hole in the bottom of the yoke and transmits the displacement of the supermagnetostriction element to an external body;

a rubbery elastic body comprising silicone rubber arranged between the flange of the vibration rod and the bottom of the yoke; and a body portion having a predetermined mass, and exerting a load on the supermagnetostriction element via the yoke in a state where the other end of the vibration rod is placed on the external body in a manner that the supermagnetostriction speaker stands by itself, so that the displacement of the supermagnetostriction element is effectively transmitted to the external body due to the mass.

2. The supermagnetostriction speaker according to claim 1, wherein the vibration rod has, at the other end thereof, a vibration contact plate having an area larger than the sectional area of the vibration rod, and transmits the displacement of the supermagnetostriction element to the external body via the vibration contact plate.

3. The supermagnetostriction speaker according to claim 2, wherein the vibration contact plate is made of a material and has an area that differ depending upon the frequency component and amplitude of vibration that is to be transmitted, and is detachably attached to the other end of the vibration rod.

4. The supermagnetostriction speaker according to any one of claims 1 to 3, further including a first bias magnet arranged between one end of the supermagnetostriction element and the lid of the yoke, and a second bias magnet arranged between the other end of the supermagnetostriction element and the vibration rod, wherein the first bias magnet and the second bias magnet generate magnetic fields in the same direction as the axial direction of the supermagnetostriction element.

5. The supermagnetostriction speaker according to claim 4, wherein the supermagnetostriction element is divided into a first supermagnetostriction element close to the lid of the yoke and a second supermagnetostriction element close to the bottom of the yoke, and a third bias magnet is arranged between the first supermagnetostriction element and the second supermagnetostriction element to generate a magnetic field in the same direction as those of the first bias magnet and the second bias magnet.

6. The supermagnetostriction speaker according to claim 5, wherein the body portion is so constituted as to possess the center of gravity on the side lower than the center of the yoke.

7. The supermagnetostriction speaker according to claim 4, wherein the body portion is so constituted as to possess the center of gravity on the side lower than the center of the yoke.

8. The supermagnetostriction speaker according to any one of claims 1 to 3, wherein the body portion is so constituted as to possess the center of gravity on the side lower than the center of the yoke.

9. A speaker comprising:

a yoke of a cylindrical shape having a bottom and a lid;

a supermagnetostriction element which:

has a first end fixed to the lid of the yoke;

has a second end which is a free end; and is arranged in the direction of a cylinder of the yoke to generate displacement depending upon a variation in a generated magnetic field;

a coil arranged to generate the magnetic field in response to signals fed from an external unit;

a vibration rod having a flange at an intermediate portion thereof and so arranged that a first end of the vibration rod comes in contact with the free end of the supermagnetostriction element and that a second end of the vibration rod penetrates through a hole in the bottom of the yoke;

a contact member connected to the second end of the vibration rod;

a rubbery elastic body arranged between the flange of the vibration rod and the bottom of the yoke; and a body portion enclosing the supermagnetostriction element and arranged so as to bias the contact member into contact with an external body and couple to the external body vibrations generated in the vibration rod by the supermagnetostriction element.

* * * * *